US005226741A

United States Patent [19]

Kumazaki et al.

[11] Patent Number: 5,226,741

[45] Date of Patent: Jul. 13, 1993

[54] PRINTING APPARATUS AND METHOD OF FORWARD AND REVERSE SHEET FEEDING TO PREVENT SKEWING

[75] Inventors: Masayuki Kumazaki; Takashi Takeuchi, both of Nagano, Japan

[73] Assignee: Seiko Epson Corporation, Tokyo, Japan

[21] Appl. No.: 960,862

[22] Filed: Oct. 14, 1992

[30] Foreign Application Priority Data

Oct. 18, 1991 [JP] Japan ..... 3-271162
Aug. 18, 1992 [JP] Japan ..... 4-219429

[51] Int. Cl.[5] ..... B41J 11/42

[52] U.S. Cl. ..... 400/579; 400/629; 271/21; 271/226

[58] Field of Search ..... 400/579, 624, 625, 629, 400/630, 636, 639.1; 271/9, 10, 116, 242, 21, 22, 225, 226

[56] References Cited

U.S. PATENT DOCUMENTS 4,248,415 2/1981 Steinhilber .
4,552,470 11/1985 Yana et al. ..... 400/629
4,652,161 3/1987 Crean et al. ..... 400/629
4,687,362 8/1987 Ruwzi ..... 400/630
4,798,374 1/1989 Ito ..... 271/9
4,802,778 2/1989 Takahashi et al. ..... 400/624
5,009,532 4/1991 Akazawa et al. ..... 400/629
5,035,413 7/1991 Yamada et al. ..... 271/9
5,051,014 9/1991 Takagi et al. ..... 400/629
5,052,836 10/1991 Genno ..... 400/629
5,062,726 11/1991 Iwomata et al. ..... 400/579

FOREIGN PATENT DOCUMENTS 58-6633 2/1983 Japan .
62-38261 8/1987 Japan .

*Primary Examiner*—Eugene H. Eickholt
*Attorney, Agent, or Firm*—Sughrue, Mion, Zinn, Macpeak & Seas

[57] ABSTRACT

A printer apparatus having a sheet feeding roller which rotates in the forward direction only when the platen rotates in the reversed direction, and a auxiliary sheet feeding roller rotating in the forward direction both when the platen rotates in the forward direction and when it rotates in the reverse direction, when the platen rotates in the forward direction, the printing sheet is nipped at a predetermined amount between the platen and the driven roller, and thereafter while the platen is rotated in the reverse direction sufficient for pushing the thus nipped sheet back while the auxiliary sheet feeding roller rotates in the forward direction to eliminate an undesirable skew, whereby the printing sheet is bent being pushed in front and in rear, and thereafter the platen is rotated in the forward direction again, to transport the printing sheet to a printing start position.

11 Claims, 8 Drawing Sheets

PRINTING APPARATUS AND METHOD OF FORWARD AND REVERSE SHEET FEEDING TO PREVENT SKEWING

BACKGROUND OF THE INVENTION

1. Field Of The Invention

The present invention relates to a printing apparatus and more particularly to a paper feeding apparatus for feeding a printing sheet separately from stacked sheets.

2. Related Art

In one example of a conventional sheet feeding apparatus for use in a printer, as disclosed in Japanese Patent Publication No. Sho. 58-6633, a printing sheet is fed with a platen rotating in the reverse direction, and even after a front end of the printing sheet reaches a nipping region of the platen and a driven roller to stop forwarding further the printing sheet is forced to be fed further so that the printing sheet is bent to thereby eliminate an undesirable skew, and then the platen is controlled to rotate in the forward direction so that the printing sheet is transported to the printing start position.

On the other hand, Japanese Patent Publication No. Sho. 62-38261 discloses another arrangement in which a printing sheet is fed separately by a pick-up roller rotating forwardly to a pair of drive rollers rotating forwardly, a sensor detects a condition of the printing sheet that a front end of the printing sheet passes completely through the pair of rollers and afterwards the pickup roller is stopped rotating while the drive roller is rotated in the reverse direction until the front end of the printing sheet is pushed out of the pair of drive rollers to thereby bend the printing sheet and so that an undesirable skew is eliminated. Afterwards, the pair of drive rollers are again rotated in the forward direction to transport the printing sheet to a printing position.

In the conventional printing apparatus for feeding a printing sheet as disclosed in the Japanese Patent Publication No. Sho. 58-6633 shown in FIG. 10, the front end of the printing sheet is abutted against the driven roller 102 and the platen 101 while they are rotating in the reverse direction as shown in FIG. 10A. Therefore, if the condition which the front end portion of the printing sheet 106 abuts against the platen 101 and driven roller 102 is irregular as shown in FIG. 10B, the front end portion of the printing sheet 106 may be wound on the roller, or folded as shown in FIG. 10C. Further, the bending (or slackening) operation applied to the printing sheet is performed only by rotating the paper feeding roller in the forward direction while checking the advance the front end portion of the printing sheet. Hence, if the printing sheet is large in thickness, it is difficult to sufficiently bend the same, and it takes a relatively long period of time to bend the sheet, with the results that the printer is lowered in through-put and in reliability.

In the conventional apparatus taught in Japanese Patent Publication No. Sho. 62-38261, the printing sheet is once fed until the sheet passes completely through the pair of drive rollers to detect such a condition of the printing sheet with the sensor and then the pair of drive rollers are controlled to rotate in the reverse direction and, further, in bending the printing sheet by turning the drive roller in the reverse direction, the sheet feeding roller is held stopped as described above. Hence, the printing sheet must be bent only by turning the drive roller in the reverse direction. For this reason, it takes a long time period and accordingly the through-put is lowered. Furthermore, in the case of a printing sheet relatively large in thickness, the roller may slip, so that the printing sheet cannot be sufficiently bent, with the result that the printer is lowered in reliability.

SUMMARY OF THE INVENTION

Accordingly, the present invention was made to eliminate the above-described difficulties accompanying conventional printing apparatuses for feeding a printing sheet in a printer. That is, an object of the invention is to provide a printing apparatus in which a printing sheet can be bent quickly to eliminate the difficulty that the printing sheet is placed skew.

The foregoing object of the invention has been achieved by a provision of a printing apparatus which includes: a platen driven to rotate forwardly and reversely; a driven roller pushed against the platen; and a sheet feeding roller for feeding a printing sheet separately from stacked sheets, characterized in that the printing apparatus further includes an auxiliary paper feeding roller positioned between the paper feeding roller and the nipping region of the platen with the driven roller and rotating in the forward direction both when the platen rotates in the forward and reverse directions, when the front end portion of a printing sheet separated from a stack of printing sheets and conveyed therefrom by the sheet feeding roller, after passing through the auxiliary sheet feeding roller reaches near the nipping region of the platen and the driven roller, the platen is being rotating in the forward direction, so that, the front end portion of the printing sheet exceeds the nipping region of the platen and the driven roller and fed further by a predetermined distance, thereafter the platen is turned in the reverse direction to thereby push back the printing sheet by a distance more than that corresponding to a distance for which an end portion of the printing sheet has transported after passing through the nipping region of the platen and the driven roller with the auxiliary sheet feeding roller being rotated in the forward direction to convey the printing sheet, so that the printing sheet is bent being pushed in front and in rear, and thereafter the platen is rotated in the forward direction again, to transport the printing sheet to a printing start position.

DESCRIPTION OF THE PREFERRED EMBODIMENTS

Preferred embodiments of the present invention will now be described with reference to the accompanying drawings.

Figure 1:
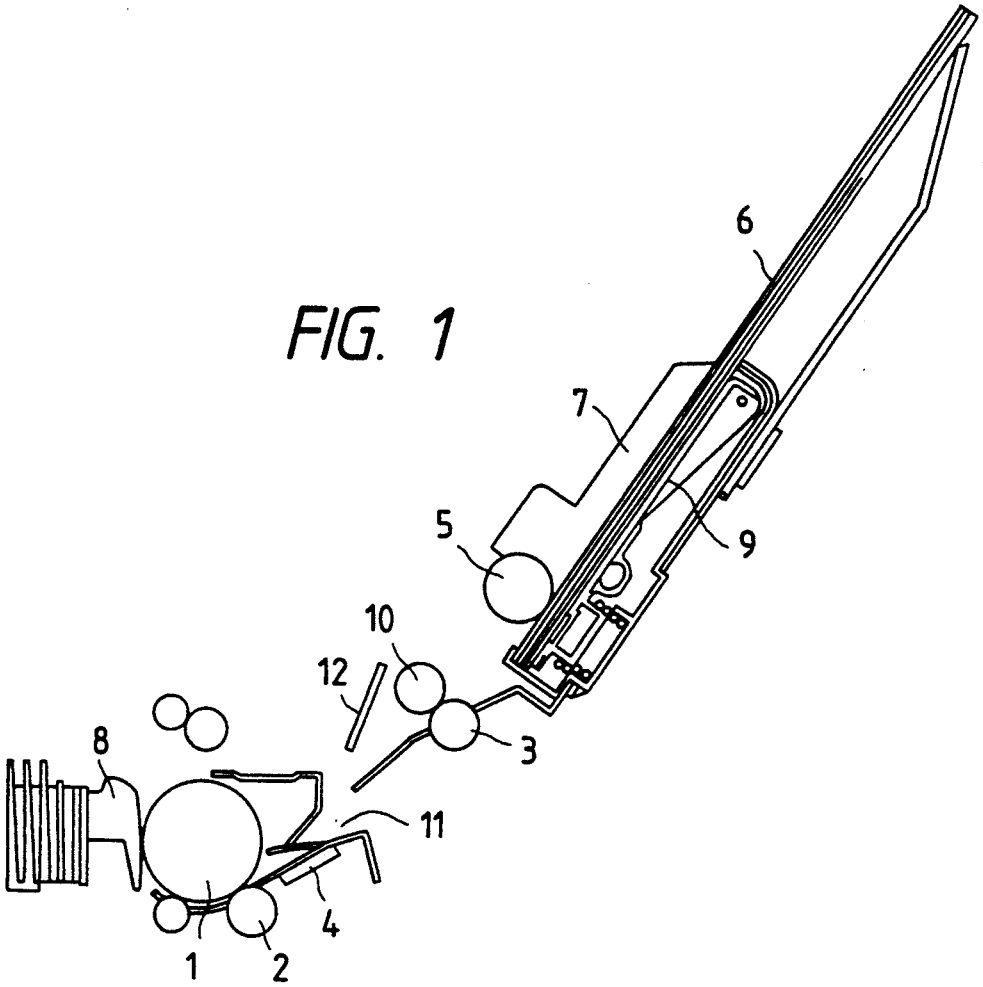
FIG. 1 is a sectional view showing essential components in an embodiment of this invention.
Figure 8:
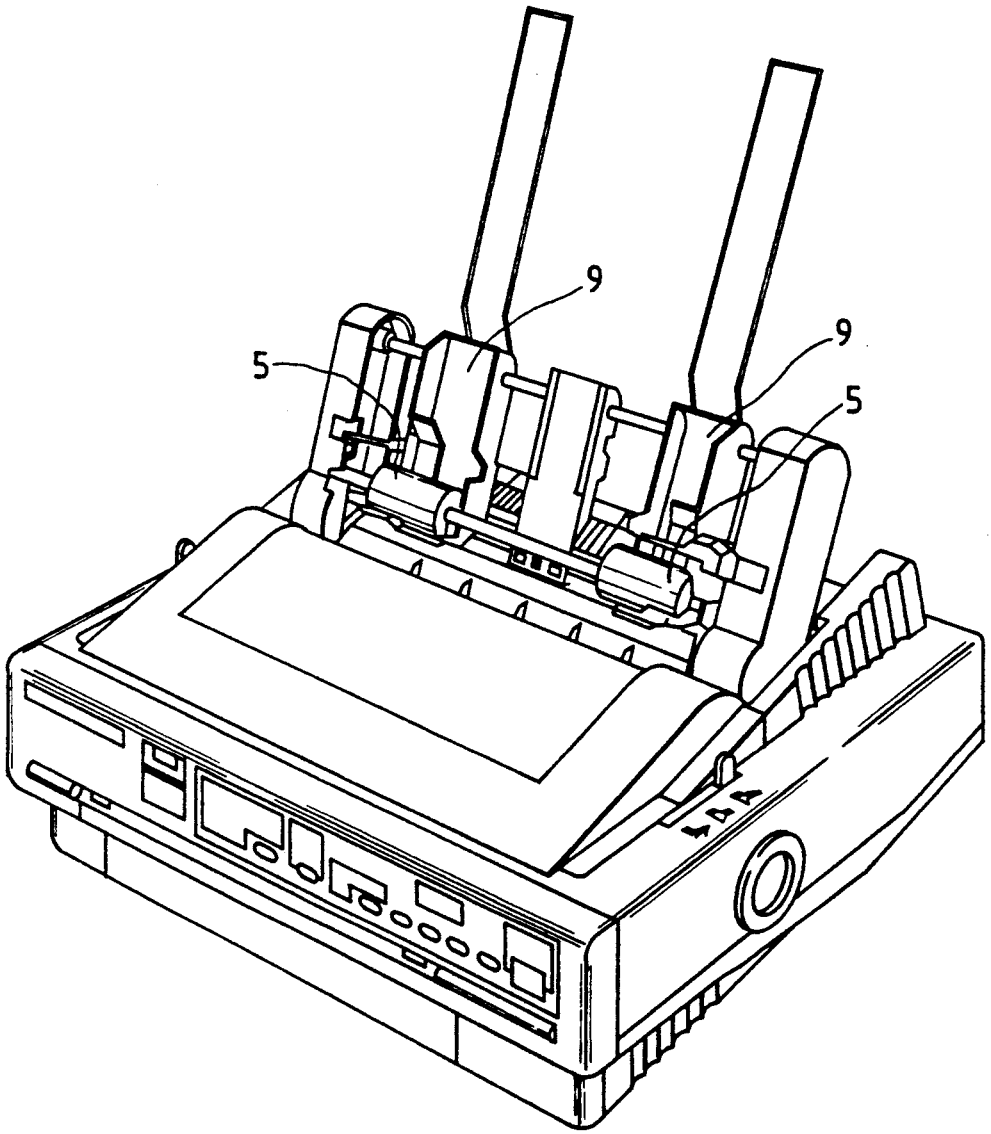
FIG. 8 is a perspective view showing a printing apparatus to which the present invention is applied.

FIG. 8 is a perspective view showing a printing apparatus to which the present invention is applied. FIG. 1 is a sectional view of a part of the printing apparatus showing a sheet transporting path between a print head and an automatic sheet feeding device for feeding a printing sheet separately from stacked sheets. The automatic sheet feeding device as shown in FIG. 1 is most popularly used. The device has a sheet accommodating section 9 for supporting printing sheets 6. A sheet feeding roller 5 is provided at the front end of the sheet accommodating section 9. An auxiliary sheet feeding roller 3 is provided closer to the printer body than the sheet feeding roller 5. An auxiliary driven roller 10 is pushed, as an idle roller, against the auxiliary sheet feeding roller 3.

On the other hand, in the printer body, a driven roller 2 made of elastic material is pushed against a platen 1, and sheet detecting means 4 (made up of a microswitch) for detecting the presence or absence of a printing sheet is disposed between the driven roller 2 and a sheet inserting inlet 11.

Figure 2:
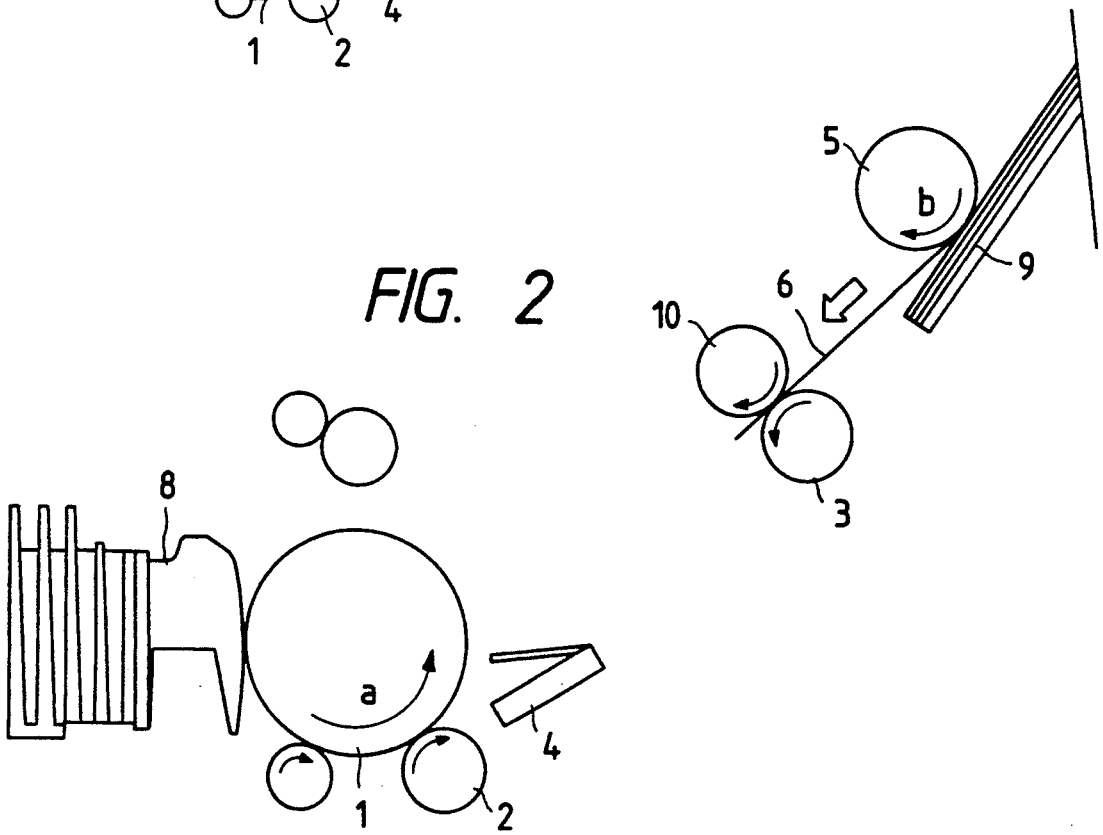
FIG. 2 is an explanatory diagram showing the first step of conveyance of a printing sheet in the embodiment of the invention.

The operations of the above-described components will be described. When, as shown in FIG. 2, the platen 1 is turned in the reverse direction (i.e., in the direction of the arrow a) through a gear train (described later) by a drive motor (not shown), the sheet feeding roller 5 is rotated in the forward direction (i.e., in the direction of the arrow b) so that a top most sheet of printing sheets 6 stacked in the sheet accommodating section 9 are separated from the stack of printing sheets one after another. The sheet feeding roller 5 is arranged to rotate forwardly by a planet gear mechanism (described later) when the platen 1 rotates reversely. The printing sheet 6 thus separated is moved on by the sheet feeding roller 5 turning in the forward direction until it is nipped between the auxiliary sheet feeding roller 3 and the auxiliary driven roller 10.

The traveling distance of the printing sheet in this operation is controlled by number of drive pulses to be supplied to a stepping motor acting as the drive motor in accordance with a length of the sheet transporting path between the sheet feeding roller 5 and a contacting point between the auxiliary sheet feeding roller 3 and the auxiliary driven roller 10.

Figure 3:
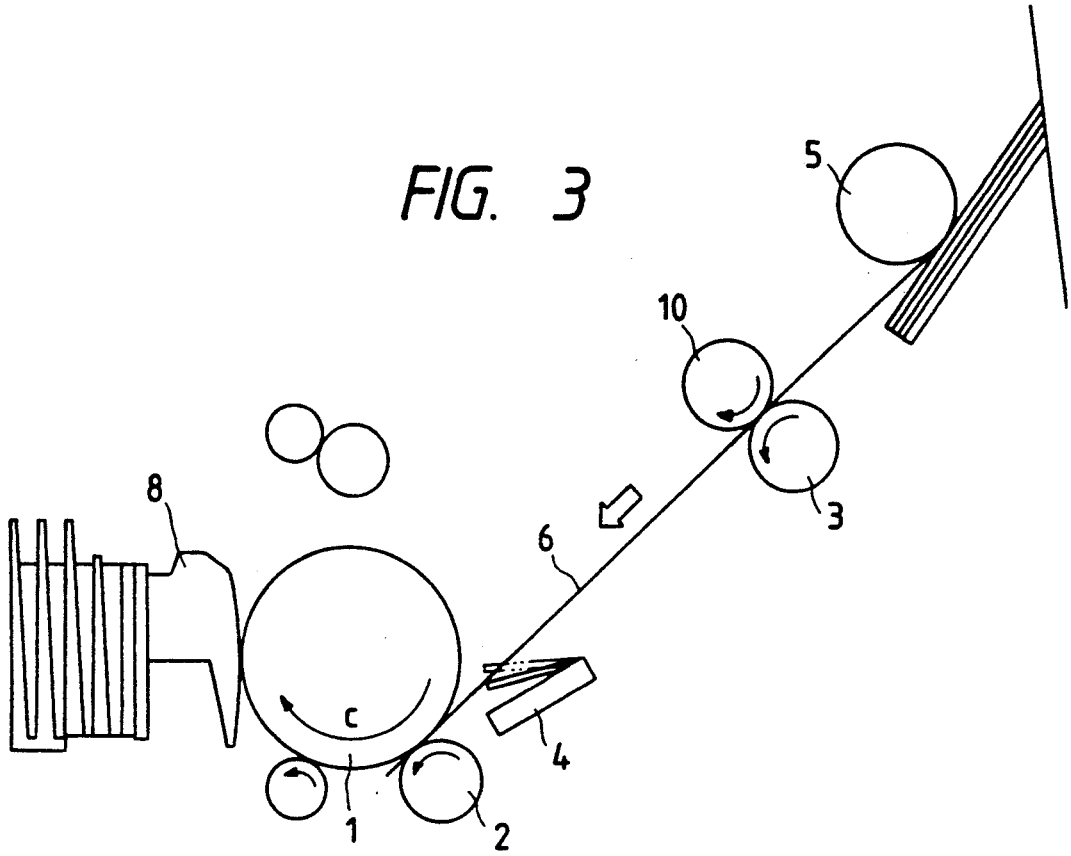
FIG. 3 is an explanatory diagram showing the second step of conveyance of the printing sheet in the embodiment of the invention.

Afterwards, the platen 1 rotates in the forward direction (i.e., in the direction of the arrow c) as shown in FIG. 3. As a result, the printing sheet 6 is further conveyed by the auxiliary sheet feeding roller 3 rotating in the forward direction through the planet gear mechanism described later and the auxiliary driven roller 10, and the position of the front end of the printing sheet 6 is detected by the sheet detecting means 4. The auxiliary sheet feeding roller 3 is arranged to rotate forwardly by the planet gear mechanism (described later) both when the platen 1 rotates forwardly and reversely.

Figure 9A:
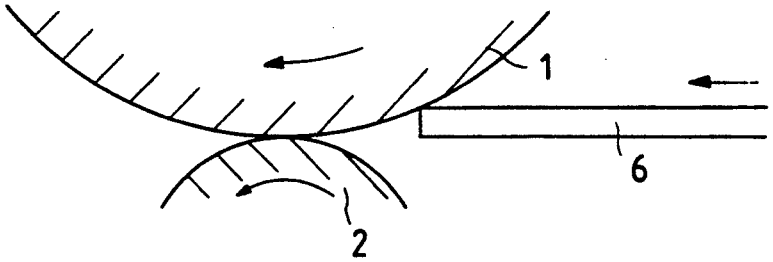
FIGS. 9A–9D are sequential view, for explaining a sheet bending operation according to the present invention.
Figure 9B:
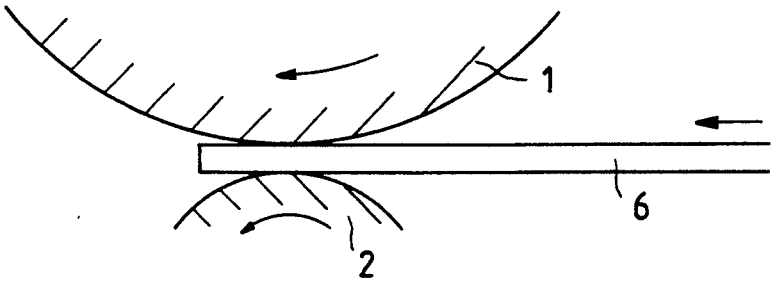

After the front edge of the printing sheet is detected in the above-described manner, the platen 1 and the auxiliary sheet feeding roller 3 continue turning a predetermined angle of rotation in the forward direction to convey the printing sheet 6 as shown in FIG. 9A, so that thereafter the printing sheet 6 is nipped at a predetermined amount (preferably 9 mm in the present embodiment) between the platen 1 and the driven roller 2 pushed against the platen 1 as shown in FIG. 9B.

The sheet feeding distance is controlled by the number of drive pulses supplied to the drive motor in accordance with the sheet transporting distance between the sheet detecting means 4 and an abutting point of the driven roller 2 against the platen 1 and the predetermined nipping amount, until the sheet feeding operation stops while the printing sheet 6 is nipped by the platen 1 and the driven roller 2 at the predetermined amount, after a front end of the printing sheet 6 is detected by the sheet detecting means 4.

Figure 4:
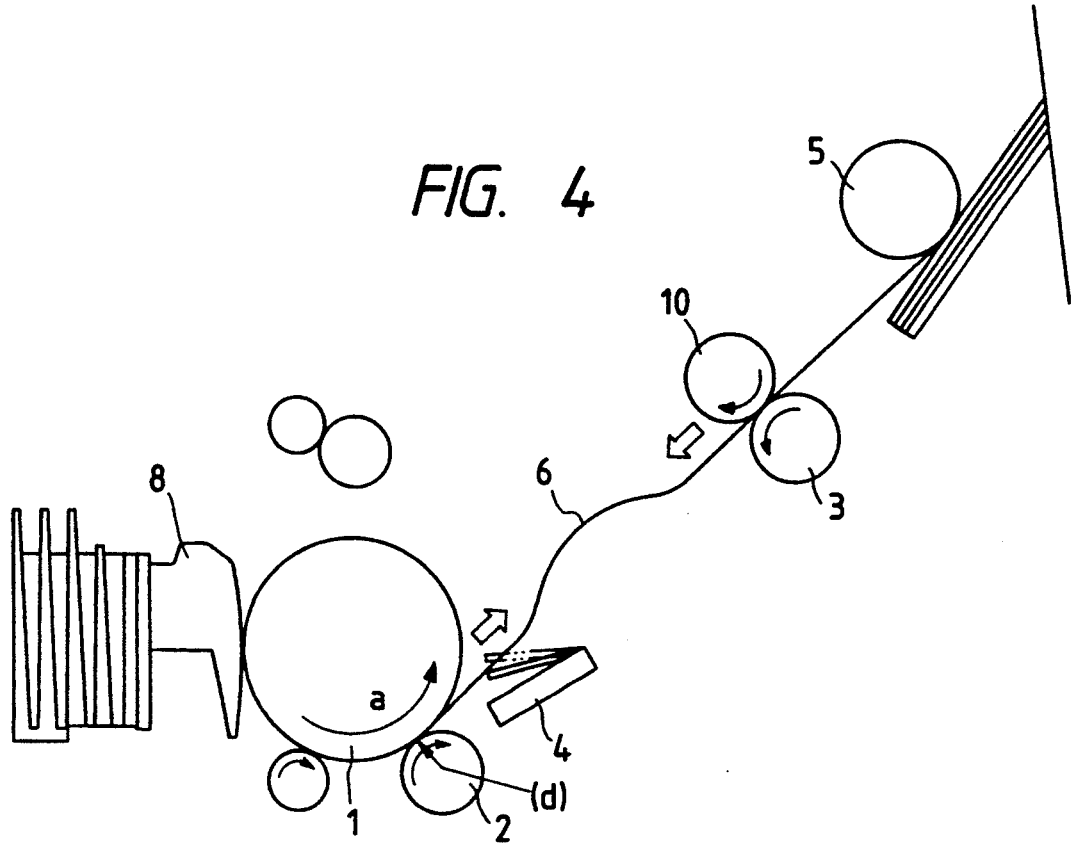
FIG. 4 is an explanatory diagram showing the third step of conveyance of the printing sheet in the embodiment of the invention.
Figure 9C:
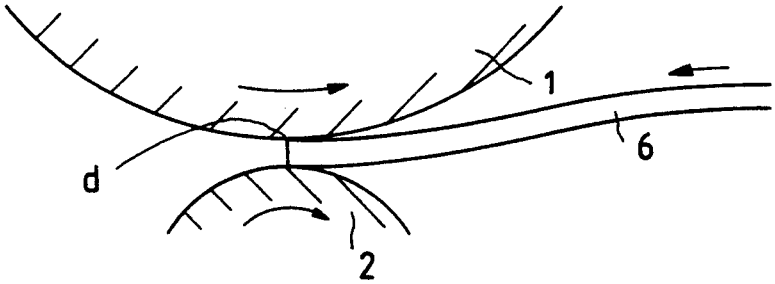
Figure 9D:
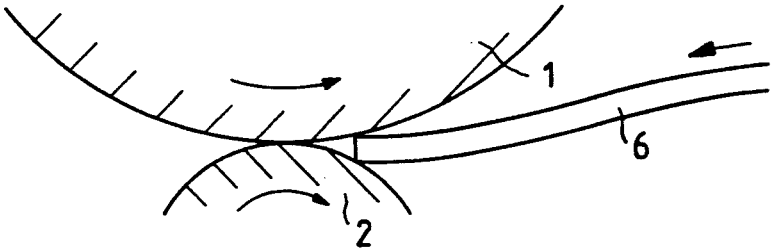
Figure 10A:
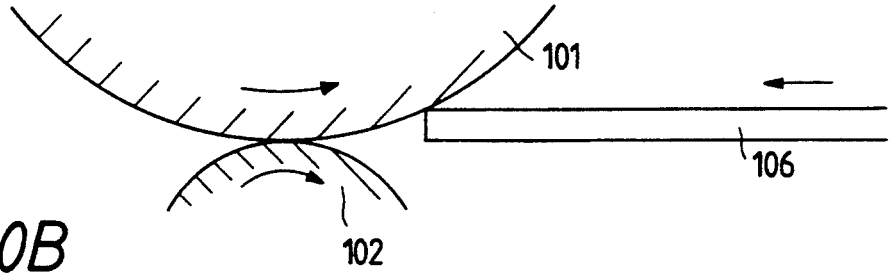
FIG. 10A PRIOR ART
FIGS. 10A–10C are sequential views for explaining a sheet bending operation according to the conventional apparatus.
Figure 10B:
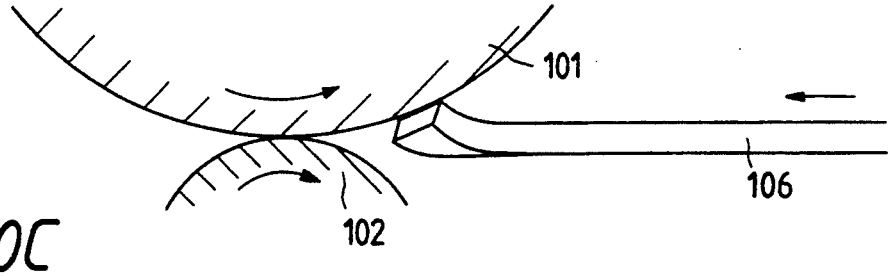
FIG. 10B PRIOR ART
Figure 10C:
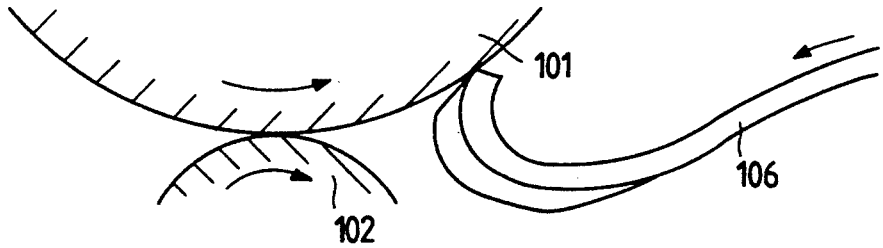
FIG. 10C PRIOR ART

Next, as shown in FIG. 4 and FIG. 9C, the platen 1 is rotated reversely (arrow a) by a sufficient amount so that the sheet 6 thus nipped is moved backwardly until the front end of the printing sheet comes to the position (d) where the platen 1 is in contact with the driven roller 2. In this operation, as the platen 1 rotates in the reverse direction (i.e., in the direction of the arrow a), the auxiliary sheet feeding roller 3 and the auxiliary driven roller 10 are turned in the forward direction; that is, the sheet 6 is bent being pushed in front and in rear as shown in FIG. 9D. Owing to this bending, since the front end of the sheet 6 is abutted against the position (d) where the platen 1 contacts to the driven roller 2, the front end of the sheet 6 is aligned to thereby eliminate the undesirable skew of the printing sheet.

The sheet bending operation is carried out as described above, with the results that the front end of the printing sheet 6 does not skew and a stable bending operation can be achieved as shown in FIG. 9 even if the front end of the sheet 6 irregularly contacts to the position (d) where the platen 1 contacts to the driven roller 2 to some extent. Further, the amount of reverse rotation of the platen 1 can be extremely small, and the period of time required for the sheet bending operation is considerably short.

Figure 5:
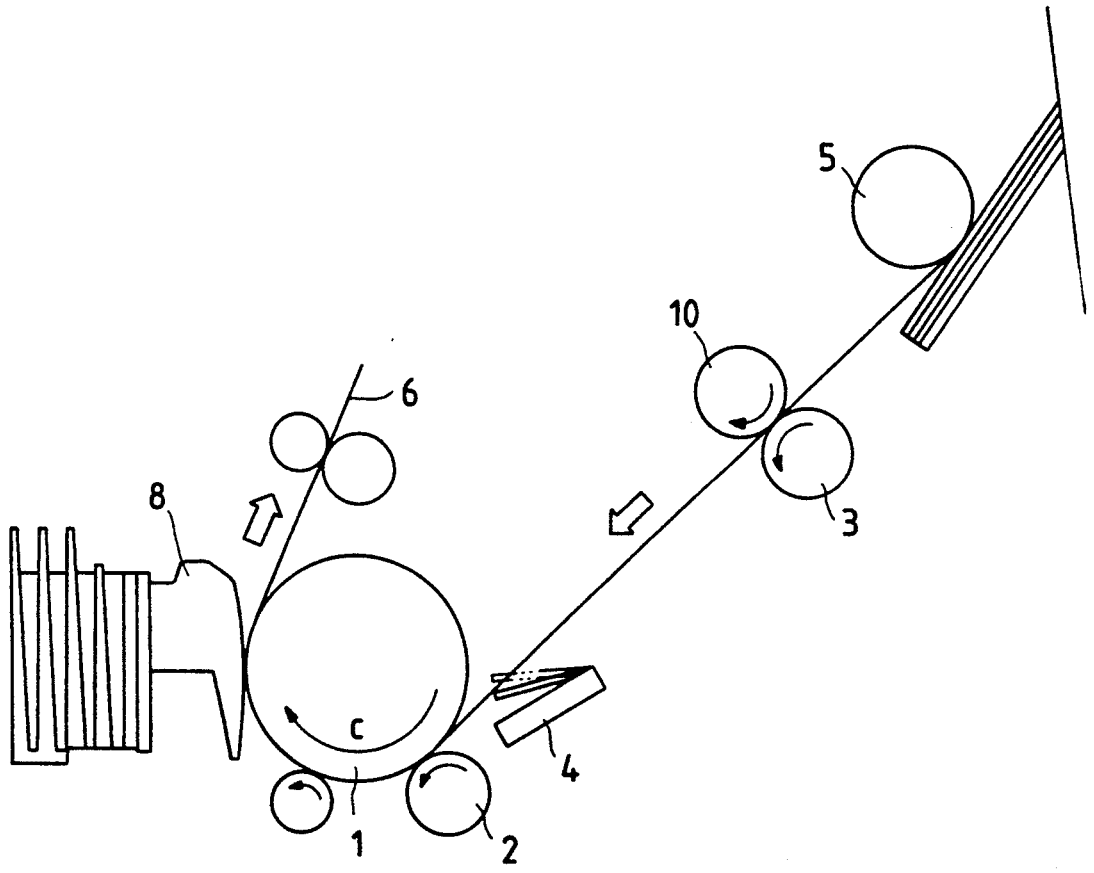
FIG. 5 is an explanatory diagram showing the fourth step of conveyance of the printing sheet in the embodiment of the invention.

When the sheet has been bent as required, the platen 1 is rotated in the forward direction (i.e., in the direction of the arrow c) to convey the sheet to the printing start position (FIG. 5).

Figure 6A:
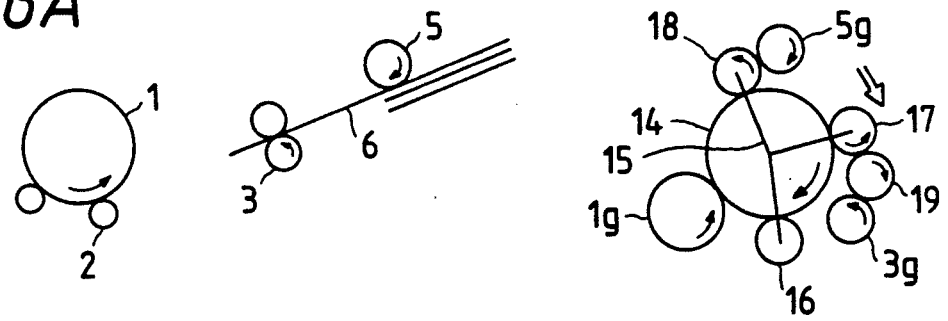
FIGS. 6A–6D are explanatory diagrams describing the sequential conveyance of the printing sheet, and the sequential operation of a gear train in the embodiment of the invention.
Figure 6B:
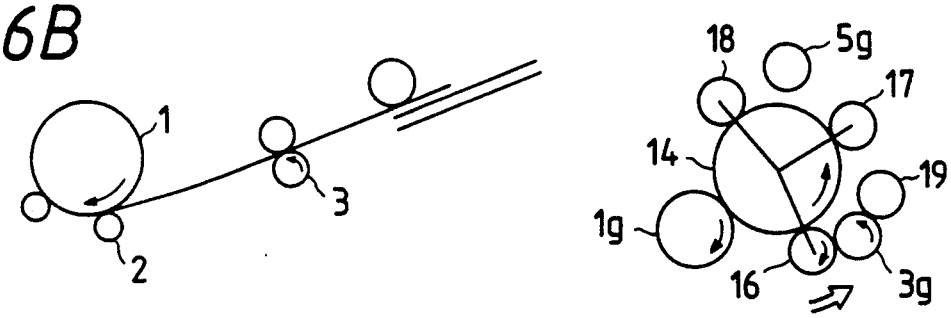
Figure 6C:
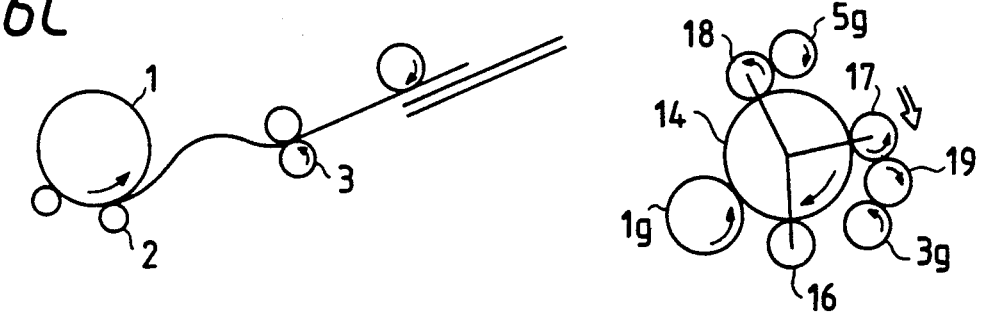
Figure 6D:
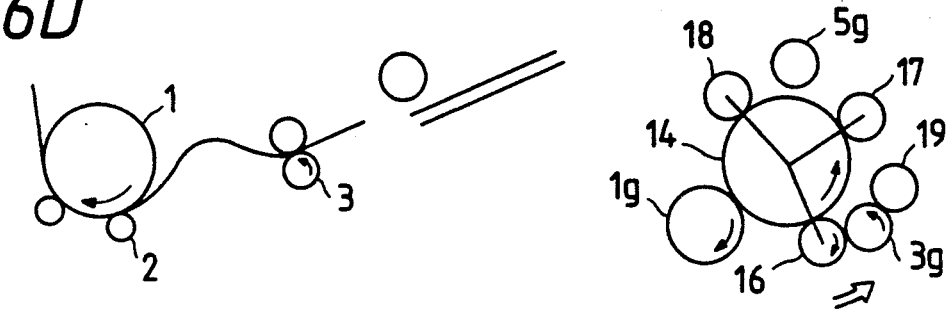

The gear train for driving those rollers, and its operation will be described with reference to FIGS. 6A–6D and 7. A platen gear 1g engages directly with a drive gear 14 which is driven by a drive motor (not shown). First, second and third planet gears 16, 17 and 18, which are coupled to one another through a common lever 15 having three arms, are engaged with the drive gear 14 in such a manner that they rolls along the drive gear 14. When the drive gear 14 is turned in the forward direction (i.e., counterclockwise in the FIGS. 6A-14 6D sequence), the first planet gear 16 swirls counterclockwise together with the drive gear 14, to transmit a forward rotation drive force to an auxiliary sheet feeding gear 3g as shown in FIGS. 6B and 6D. When the drive gear 14 is rotated in the reverse direction, the third planet gear 18 swirls clockwise in FIG. 6, to transmit a forward rotation drive force to a sheet feeding gear 5g as shown in FIGS. 6A and 6C.

Thus, at the sheet feeding start time instant (time point a in FIG. 7), the drive gear 14 starts to rotate in the reverse direction, and the second planet gear 17 which positions to swirl clockwise around the drive gear 14 transmits the forward rotation drive force through the idler gear 19 to the auxiliary sheet feeding gear 3g, and similarly the third planet gear 18 transmits the forward rotation drive force to the sheet feeding gear 5g, so that the sheet 6 is transported by the sheet feeding roller 5.

When the sheet feeding operation is advanced, i.e., when the front edge of the printing sheet reaches the auxiliary sheet feeding roller 3 (at a time point b in FIG. 7), the drive motor is turned in the forward direction. Thereupon, the first planet gear 16 swirling counter-clockwise around the drive gear 14 with the changing time $\Delta t$ is engaged with the auxiliary sheet feeding gear 3g, to transmit the forward rotation drive force to the latter 3g, while the platen gear 1g engaged directly with the drive gear 14 rotates the platen 1 in the forward direction, to allow the auxiliary sheet feeding roller 3 to continue the sheet feeding operation.

Afterwards, the front end of the printing sheet 6 passes through the sheet detecting means 4 and reaches the abutting point of the driven roller 2 against the platen 1 and, moves further by a predetermined distance $\Delta l$, and the front end of the sheet 6 is nipped by the predetermined distance amount $\Delta l$ from the contact point between the platen 1 and the driven roller 2 (time point c in FIG. 7), the drive motor rotates the drive gear 14 in the reverse direction for a predetermined distance (corresponding to time period t in FIG. 7) which is sufficient to move the front end of the sheet 6 back to the contact point between the platen 1 and the driven roller 2, so that the platen 1 is turned in the opposite direction through the platen gear 1g. Therefore, as shown in FIG. 7, in the earlier part of the period of time between the time instants c and d, the platen 1 returns the front edge of the printing sheet 6 as much as an amount of draw $\Delta l$.

The auxiliary sheet feeding roller 3, receiving the forward rotation drive force through the idler gear 19 from the second planet gear 17, feeds the printing sheet 6 again during the period of time $t-\Delta t$ after the planet gear 17 is switched, to slacken (or bend) the printing sheet 6 as much as $(L-l)$ between the platen 1 and the auxiliary sheet feeding roller 3. As a result, the front edge of the printing sheet is aligned with the axis Of the platen by the back tension of the printing sheet 6 itself; that is, the printing sheet 6 is prevented from skewing.

Figure 7:
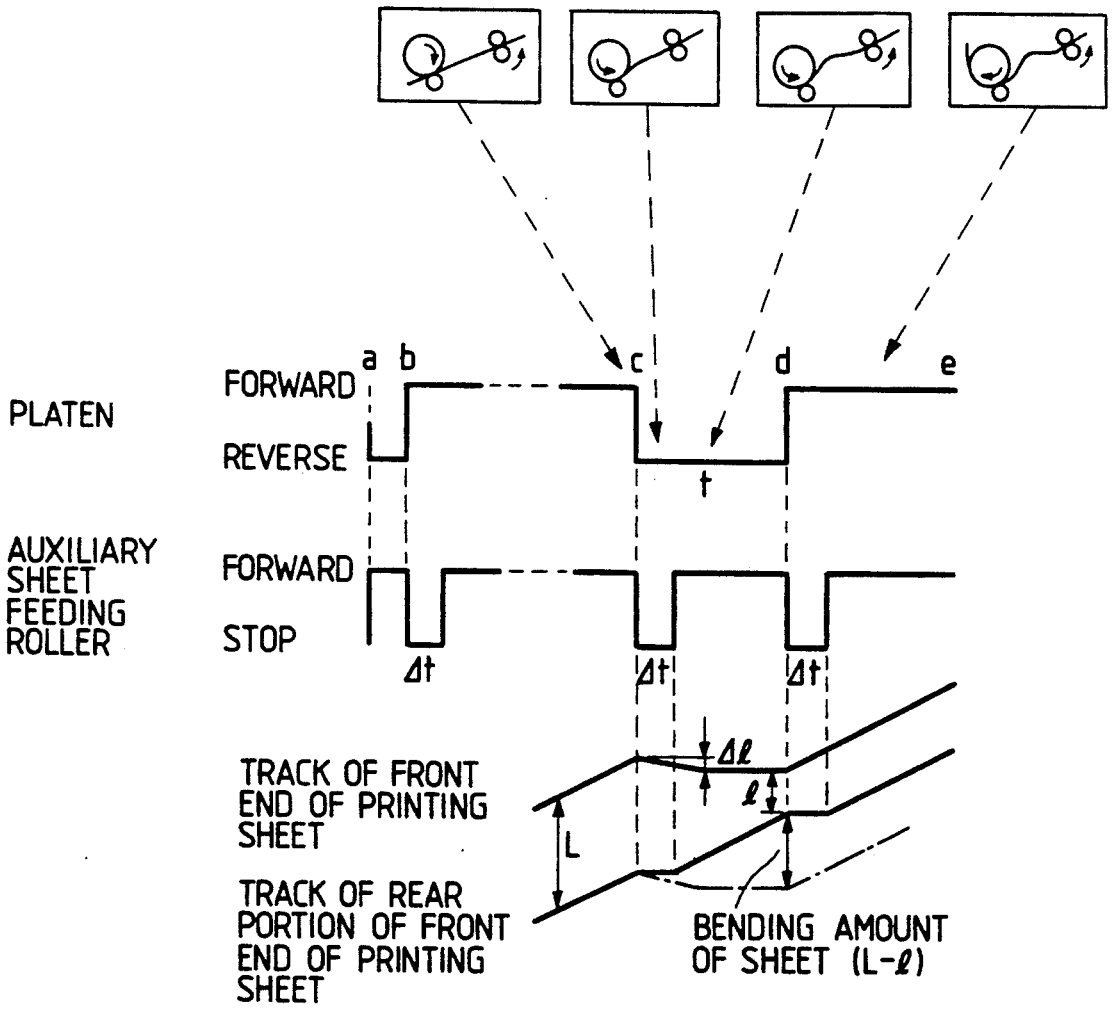
FIG. 7 is an explanatory diagram for a description of the positions of the printing sheet and the operations of rollers in the embodiment of the invention.

When the period of time t has passed; i.e., at the time instant d in FIG. 7, the drive gear 14 is turned in the forward direction again, to turn the platen in the forward direction to draw the printing sheet 6, and thereafter the auxiliary sheet feeding roller 3 which has started turning in the forward direction after the period of time $\Delta t$ that the planet gear 16 is switched, feeds the remaining part of the printing sheet 6.

The platen 1, the auxiliary sheet feeding roller 3, and the sheet feeding roller 5 are controlled as described above. However, the above-described method may be replaced by a method in which plungers are used to control the gear train, or a method in which a respective drive motor independent for each platen 1, auxiliary sheet feeding roller 3 and sheet feeding roller 5 is employed.

The printer is constructed as described above, and is operated according to the above-described method. Hence, the sheet bending operation can be achieved quickly and accurately. Furthermore, even if the front end portion of the printing sheet 6 is irregularly brought into contact with the driven roller 2 or the platen 1, it will not be folded, that is, the conveyance of the printing sheet 6 to the printing start position is improved in accuracy.

If the sheet detecting means 4 is positioned at downstream of the sheet transporting path of the pair of rollers for bending the sheet by rotating reversely as in the case of Japanese Patent Publication No. Sho. 62-38261 mentioned above, then in the case where the printing sheet is manually inserted into the printer body through the sheet inserting inlet, it is impossible for the detecting means to determine the presence or absence of the printing sheet, and it is rather difficult to handle the printing sheet.

On the other hand, in the invention, with the sheet detecting means 4 arranged as described above, even when the printing sheet is manually inserted along the sheet guide 12 towards the sheet inserting inlet 11, the presence or absence of the printing sheet can be determined by the sheet detecting means 4, which will eliminate the above-described difficulty that it is rather difficult to handle the printing sheet.

As was described above, in the printing apparatus of the invention, after the printing sheet separated from the stack of printing sheets and conveyed by the sheet feeding roller passes through the auxiliary sheet feeding roller, with the platen being rotated in the forward direction the printing sheet is nipped between the platen and the driven roller as much as required, and then the platen is turned in the reverse direction through an angle of rotation more than that corresponding to the distance for which the printing sheet has passed through the nipping region of the platen and the driven roller. The auxiliary sheet feeding roller is turned in the forward direction, so that the printing sheet is bent being pushed in front and in rear. Thus, irrespective of the type of the printing sheet, the printing sheet can be bent suitably, positively and short in time, so that the elimination of the undesirable skew can be achieved quickly.

What is claimed is:

1. A printing apparatus comprising:

a platen rotating forwardly and reversely;

a driven roller abutted against said platen;

a sheet feeding roller for feeding a printing sheet separately from stacked sheets;

an auxiliary sheet feeding roller disposed between an abutting point of said driven roller against said platen and said sheet feeding roller, said auxiliary sheet feeding roller rotating forwardly both when said platen rotates forwardly and reversely;

wherein said platen rotates forwardly when said printing sheet reaches close to an abutting position of said driven roller against said platen after a front end of the printing sheet fed by said sheet feeding roller passes through said auxiliary sheet feeding roller, after the printing sheet is fed by a first predetermined distance exceeding the abutting position of said driven roller against said platen said platen rotates reversely by a second predetermined distance larger than said first predetermined distance while said auxiliary sheet feeding roller rotated forwardly whereby bending the printing sheet and, thereafter said platen rotates forwardly to transport the printing sheet to a printing start position.

2. The printing apparatus of claim 1, further comprising means for detecting the printing sheet, said detection means is disposed between said auxiliary sheet feeding roller and said platen.

3. The printing apparatus of claim 2, wherein the printing sheet transporting distance after the presence of the sheet is detected by said detection means is determined in accordance with a sheet feeding path between the abutting point of said driven roller against said platen and said detection means and with said first predetermined distance.

4. The printing apparatus of claim 3, wherein said platen, driven roller, sheet feeding roller and auxiliary sheet feeding roller are driven by a pulse motor.

5. The printing apparatus of claim 4, wherein said pulse motor is actuated by drive pulses the number of which is determined by the printing sheet transporting distance.

6. The printing apparatus of claim 1, wherein said first predetermined distance is 9 mm.

7. The printing apparatus of claim 1, wherein said driven roller is formed of an elastic material.

8. Method of feeding a printing sheet separately from stacked sheets in a printing apparatus having a platen, a driven roller abutted against said platen, a sheet feeding roller and an auxiliary sheet feeding roller, comprising steps of:

feeding a printing sheet separately from stacked sheets by said sheet feeding roller;

rotating said platen forwardly while the printing sheet is transported through said auxiliary sheet feeding roller and reaches close to an abutting point of said driven roller against said platen;

rotating further said platen and said sheet feeding roller forwardly to feed the printing sheet by a first predetermined distance exceeding the abutting point of said driven roller against said platen;

rotating said platen reversely to feed the printing sheet backwardly by a second predetermined distance larger than said first predetermined distance while rotating said auxiliary sheet feeding roller forwardly to bend the printing sheet; and rotating said platen forwardly to transport the printing sheet to a printing start position.

9. The method of feeding a printing sheet of claim 8, further comprising step of detecting a front end of the printing sheet before the sheet reaches the abutting point of said driven roller against said platen.

10. The method of feeding a printing sheet of claim 8, wherein said first predetermined distance is 9 mm.

11. The method of feeding a printing sheet of claim 9, wherein the printing sheet transporting distance after the presence of the sheet is detected is determined in accordance with a sheet feeding path between the abutting point of said driven roller to said platen and said detection means and with said first predetermined distance.

* * * * *